US007562477B2

(12) United States Patent
Kurple et al.

(10) Patent No.: US 7,562,477 B2
(45) Date of Patent: Jul. 21, 2009

(54) MULTI-USE FLOOR SIGN

(75) Inventors: William M. Kurple, St. Charles, MO (US); Anthony F. Maiuro, St. Charles, MO (US); Thomas Burns, Chesterfield, MO (US)

(73) Assignee: Continental Commercial Products LLC, Bridgeton, MO (US)

( * ) Notice: Subject to any disclaimer, the term of this patent is extended or adjusted under 35 U.S.C. 154(b) by 856 days.

(21) Appl. No.: 10/803,839

(22) Filed: Mar. 18, 2004

(65) Prior Publication Data

US 2005/0204601 A1 Sep. 22, 2005

(51) Int. Cl.
*G09F 7/02* (2006.01)

(52) U.S. Cl. ..... 40/611.02; 116/63 P; 40/388

(58) Field of Classification Search ..... 40/610, 40/388, 390, 403, 533, 494, 611.02; 404/6, 404/9; 116/63 P; D20/10; 248/165, 166
See application file for complete search history.

(56) References Cited

U.S. PATENT DOCUMENTS

| | | | | |
|---|---|---|---|---|
| 2,501,044 | A | 3/1950 | Gianelloni, Jr. | |
| 2,844,897 | A | 7/1958 | Vance, Jr. | |
| 2,864,191 | A | 12/1958 | Hagen | |
| 3,936,967 | A | 2/1976 | Davis | |
| 4,005,537 | A | 2/1977 | von Camber et al. | |
| 4,062,139 | A | 12/1977 | Klosel | |
| 4,178,874 | A | 12/1979 | Berns et al. | |
| 4,253,260 | A | 3/1981 | Maza et al. | |
| 4,318,238 | A | 3/1982 | Macarle, Jr. | |
| 4,796,269 | A | 1/1989 | DeFreez et al. | |
| 4,796,369 | A | 1/1989 | Hamann | |
| 4,905,388 | A * | 3/1990 | Sinkow | 40/110 |
| 4,928,415 | A | 5/1990 | Walters | |
| 4,999,937 | A | 3/1991 | Bechtold | |
| 4,999,938 | A | 3/1991 | Behling | |
| 5,009,541 | A | 4/1991 | Thurston | |
| 5,046,885 | A | 9/1991 | Thurston | |
| 5,156,274 | A | 10/1992 | Williams, Jr. et al. | |
| 5,621,992 | A | 4/1997 | Mandell et al. | |
| 5,720,464 | A | 2/1998 | Meinscher et al. | |
| 5,987,794 | A | 11/1999 | Lavi et al. | |
| 6,003,257 | A | 12/1999 | Stokes | |
| 6,131,320 | A * | 10/2000 | Eberle et al. | 40/610 |
| 6,298,592 | B1 | 10/2001 | Baier | |
| 6,493,969 | B2 * | 12/2002 | Devos | 40/120 |
| 6,615,523 | B1 | 9/2003 | Curbelo et al. | |
| 6,651,367 | B1 | 11/2003 | Barragan | |

* cited by examiner

*Primary Examiner*—Joanne Silbermann
(74) *Attorney, Agent, or Firm*—Thompson Coburn LLP; Joseph M. Rolnicki

(57) ABSTRACT

A self-standing floor sign including two support panels and a plurality of movable panels. The support panels each have a proximal and a distal end and are pivotally coupled to each other via their proximal ends to allow relative movement of the panels between a closed and an open position. When closed, the support panels are generally parallel to each other, whereas when open, the distal ends are spaced apart and allow the sign to stand on the floor. Each of the movable panels has a proximal and a distal end and a portion therebetween having two surfaces. Each movable panel is rotatable between a first position where the movable panel is supported by one of the support panels with one of its surfaces being visible, and a second position where the movable panel is supported by the other support panel and its other surface is visible.

44 Claims, 7 Drawing Sheets

MULTI-USE FLOOR SIGN

FIELD OF THE INVENTION

This invention relates generally to floor signs and, more particularly to self-standing floor signs for displaying multiple messages.

BACKGROUND OF THE INVENTION

It is often desirable to alert pedestrians to conditions caused by floor maintenance. For instance, while a waxed floor is drying people that tread on the floor will mar the uniform coating if they do not detour around the treated area. Custodians will typically place a self-standing sign on the floor with an appropriate message for passersby alerting them to the need to stay off of the wet floor. Signs in common use include messages such as "Wet Floor," "Detour," and "Area Closed For Cleaning."

Use of floor signs, though, is not limited to janitorial situations. Construction activities frequently make it desirous to post a sign alerting traffic to conditions caused by the construction. Likewise, law enforcement and other emergency respondents frequently need to cordon off areas for temporary access control. Moreover, entertainment events (or any gathering where large numbers of attendees may be unfamiliar with their surroundings) often create the need to provide pedestrians with messages directing them to their destination. Furthermore, the messages to be conveyed may change over time or with circumstances. All of these applications, and others, call for the use of self-standing signs to convey appropriate messages to individuals in particular areas.

Others have attempted to provide multi-use signs in the past. One attempt provided a sign that includes a center rod bisecting the sign and multiple panels each containing one half of a message. These half-message panels are connected to the rod by an ear lying perpendicular to the plane defined by the panel. Thus, to form one message, these earlier signs require the cooperation of a front of one half-message panel and the back of another, adjacent, half-message panel.

Still other prior attempts at providing multi-use signs have provided a single sign extension affixed to the sign and extending vertically therefrom. However, because these extensions increase the overall height of the sign, the sign is more cumbersome to handle. Additionally, because the extension is affixed to the sign, changing the message on the extension requires disassembly of the sign. Accordingly, changing the message requires time and effort. Moreover, the extensions may become separated from the sign and misplaced. Furthermore, because the message on the original sign is fixed, it is possible that any given extension may carry a message that conflicts with the message of the original sign. Accordingly, some extensions may be incompatible with some signs.

Thus, a need exists to provide signs that are capable of selectively conveying multiple messages without requiring cumbersome techniques to change the displayed message.

SUMMARY OF THE INVENTION

It is in view of the above problems that the present invention was developed. The invention provides self-standing floor signs that allow the user to quickly, conveniently, and inexpensively change the message displayed on a sign. Additionally, the present invention provides a kit to retrofit existing single-use message signs to include multi-use capability.

In a first preferred embodiment, the present invention provides a self-standing floor sign that includes two support panels, a transverse handle, a runner, and at least one movable panel. Each of the panels includes a surface on which messages may be displayed. The transverse handle is coupled to the proximal ends of the support panels in such a manner that the support panels define an angle therebetween. Moreover, the coupling of the handle and the support panels defines a handle aperture between the handle and the panels. The runner encircles the handle with the movable panels sliding along the runner. Thus, a user may select the messages for display by repositioning the movable panel.

The sign may also include a second movable panel that slides along the runner so that the first movable panel can display a message from one side of the sign and the second movable panel can display a message from the other side of the sign. Additionally, the messages on the movable panels may be the same. Several techniques may be used to retain the runner on the sign. For instance, a retainer can couple the runner and the handle. In the alternative, the handle and one of the support panels may cooperate to retain the runner in the handle aperture.

Other preferred embodiments provide movable panels with additional useful features. In one such preferred embodiment, the handle aperture may extend through the movable panels. In yet another preferred embodiment, the movable panels may include extensions from their proximal ends that extend beyond the location where the panel slidably engages the runner. Furthermore, the extensions may extend to the handle and cooperate with each other to concentrically space the runner apart from the handle. In other alternative embodiments, the panels may include an eyelet that slidably engages the runner. In still other preferred embodiments, the runner may be a ring, a band, a loop, or a lanyard, and may completely, or partially, encircle the handle.

In yet another preferred embodiment, the present invention provides a kit for self-standing floor signs where the signs typically include a first and a second support panel and a transverse handle. The support panels include surfaces on which messages may be displayed. The transverse handle is coupled to the proximal ends of the support panels so that the support panels define an adjustable angle therebetween. Additionally, the handle and the support panels define a handle aperture between them when they are coupled.

The kit of the current embodiment includes a runner and a movable panel for displaying a message. The movable panels slidably engage the runner. Moreover, the runner is adapted to at least partially encircle the handle, although the runner may also completely encircle the handle. Further, the accessory may include a second movable panel similar to the first. In other preferred embodiments, a retainer is provided to couple the accessory to the sign. In the alternative, the runner may be adapted to be retained by the handle and the first support panel.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
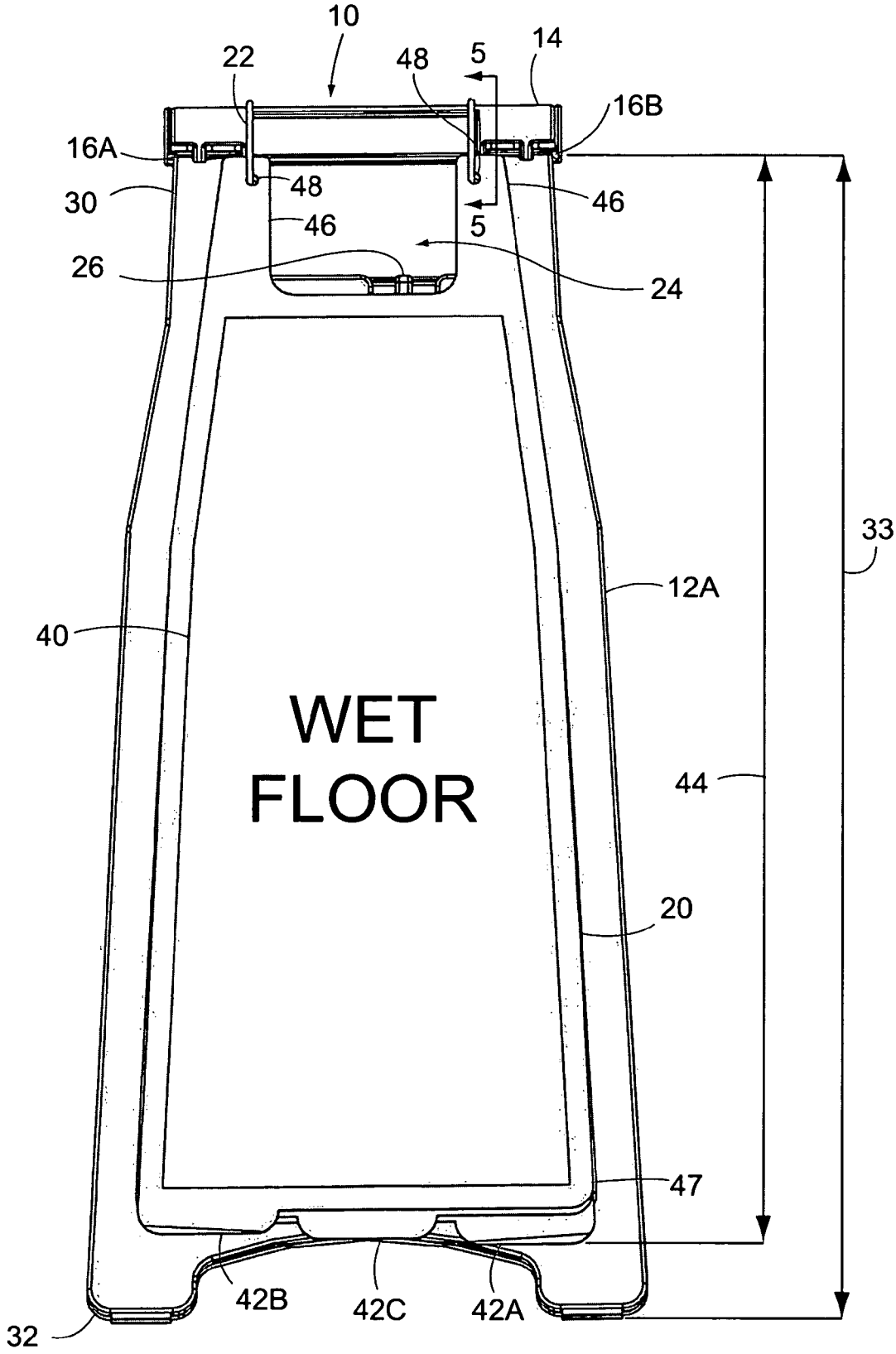
FIG. 1 illustrates a sign constructed in accordance with a preferred embodiment of the present invention.

Referring to the accompanying drawings in which like reference numbers indicate like elements, FIG. 1 illustrates a self-standing floor sign in accordance with a preferred embodiment of the present invention. In general the sign includes a pair of stationary support panels and a plurality of movable message panels. The user selects which message panels are visible by positioning the movable panels on one side, or the other, of the sign.

Hereinafter, the term "sign" will refer to an assembly for displaying at least one message. A "message" is a symbol or group of symbols (e.g. graphic or textual) or other indicia that conveys information. A "message panel" is a panel that has a message imprinted on it or added by other techniques suitable for displaying the message. For example a message may be added to a panel by painting, embossing, or other suitable means. Further, any sign capable of selectively displaying a plurality of messages is herein termed "multi-use."

Figure 2:
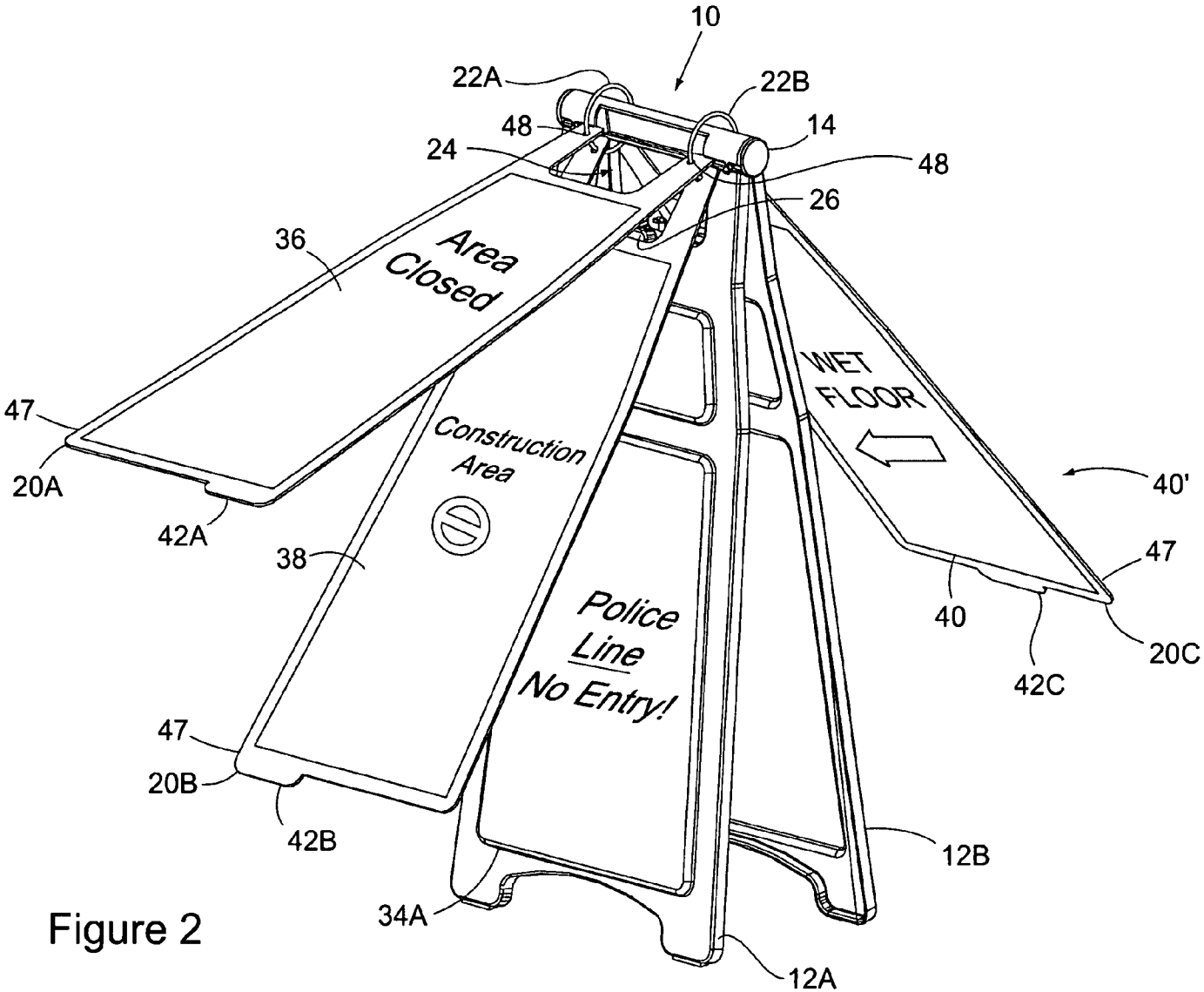
FIG. 2 illustrates a perspective view of the preferred embodiment of FIG. 1.

With reference now to FIGS. 1 and 2, the sign 10 includes a pair of support panels 12, a handle 14, a pair of hinges 16, a plurality of movable panels 20A to 20C, a runner 22, a handle aperture 24 and a cordon tape hook 26. Each of the support panels 12 includes a proximal (or upper) end 30, a distal end 32, a length 33 and a surface 34 (see FIGS. 2 and 3). The movable panels 20A to 20C also include surfaces 36, 38, and 40 respectively. Preferably, the movable panels 20 include index tabs 42 and have a length 44. The length 44 is defined between the proximal and distal ends 46 and 47. Additionally, the movable panels 20 may include an eyelet 48 near the proximal end 46.

In general the sign 10 is constructed as follows. The handle 14 is coupled to the support panels 12 via the hinges 16. The runner 22 encircles the handle 14 and carries the movable panels 20 via the eyelets 48. The eyelets 48 allow the movable panels 20 to slide along the runner 22. Each of the movable panels 20 typically rests against one of the support panels 12 or against other movable panels 20 already resting against a support panel 12. In a preferred embodiment, each movable panel 20 rotates between a first position wherein the support panel 12A supports the movable panel 20 and a second position wherein the other support panel 12B supports the movable panel 20. In the first position one surface (e.g. surface 36) is visible while in the second position the other surface (e.g. 36') is visible. Preferably, the proximal end 30 of each of the support panels 12 couples to the handle 14 near outer ends of the handle 14. The proximal end 46 of each of the movable panels 20 lays inward from the support panels 12 and may at least partially, and preferentially substantially, overlap the support panels 12 as shown, in FIGS. 1 and 2. The runner 22 passes through the eyelets 48 of the movable panels 20 near the handle aperture 24. Approximately centered along the handle 14, the handle aperture 24 passes through all of the panels 12 and 20 to facilitate the user gripping the handle 14.

Figure 3:
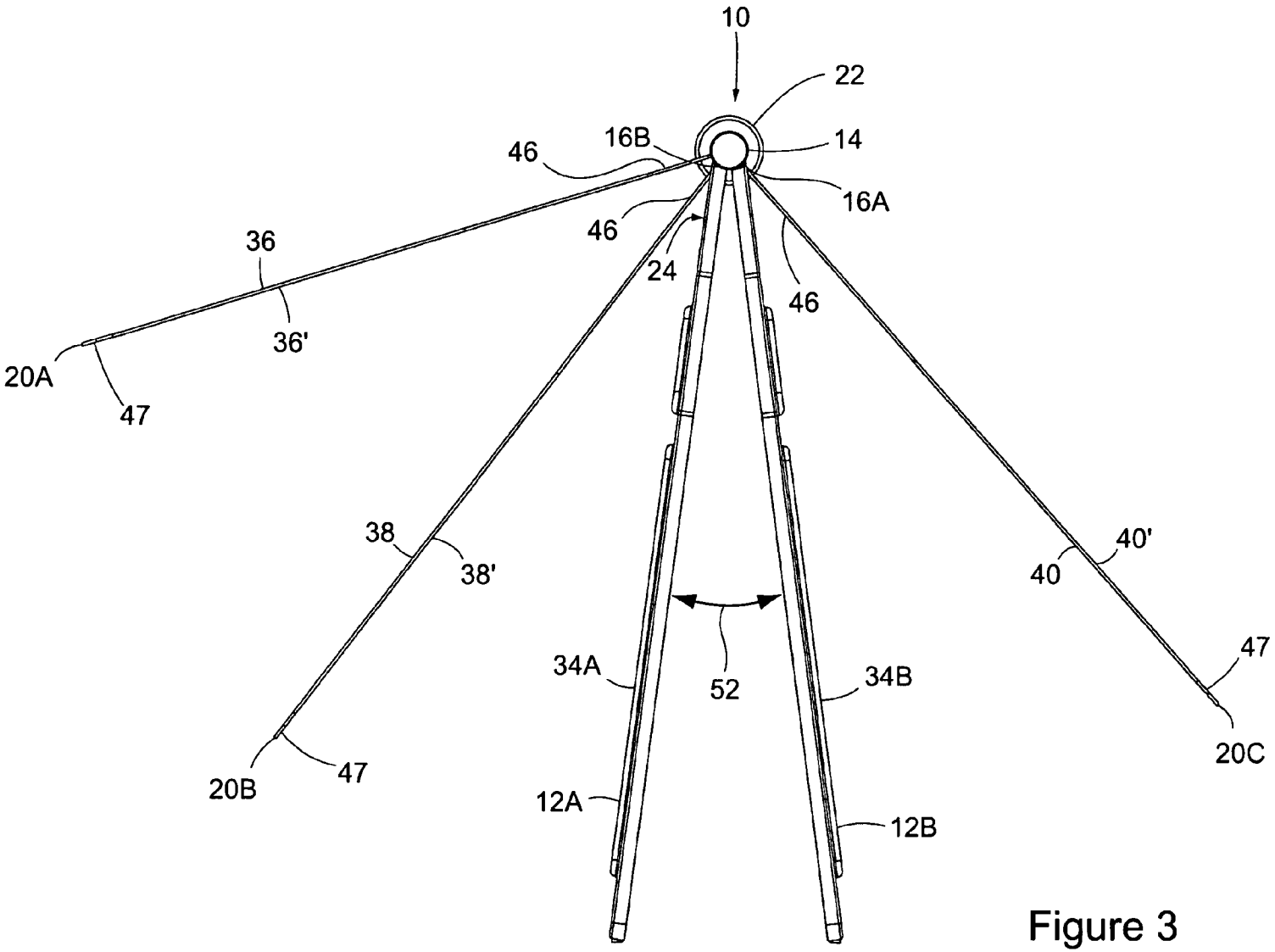
FIG. 3 illustrates a side elevational view of the preferred embodiment of FIG. 1.
Figure 4:
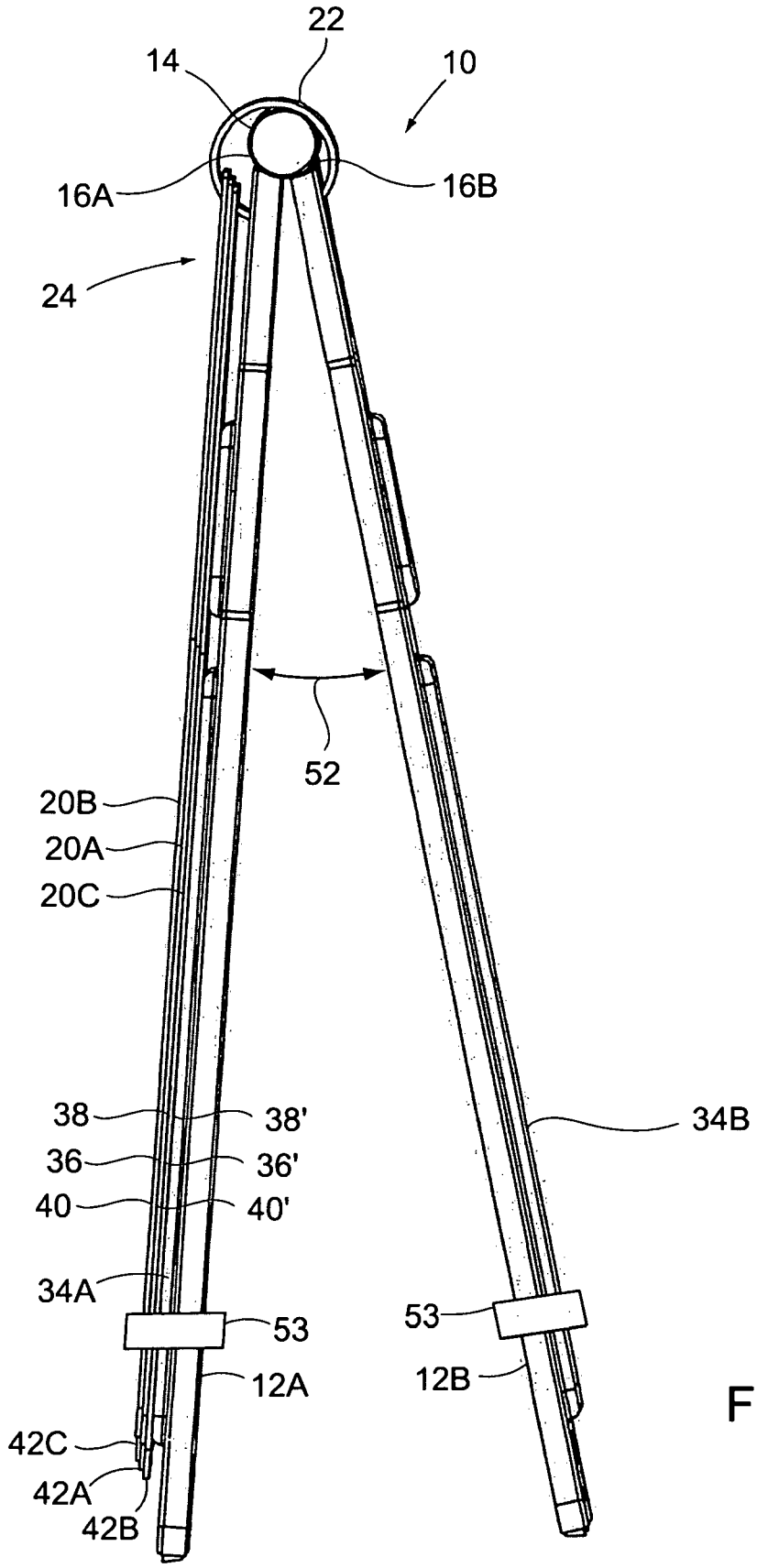
FIG. 4 illustrates a side elevational view of a sign in accordance with another preferred embodiment of the present invention.

Turning now to FIG. 3, various features of the panels 12 and 20 are further illustrated. In particular, the support panels 12 have surfaces 34 whereupon messages or message panels may be displayed. The movable panels 20 have surfaces 36, 38, and 40 (on the clockwise side of the panels 20 as viewed in FIG. 3) and surfaces 36', 38', and 40' (on the counterclockwise side of the panels 20 as viewed in FIG. 3). Thus, as indicated by FIG. 3, surfaces 36 and 40' may be the outermost surfaces of the sign 10, whereas FIG. 4 shows outwardly facing surfaces 40 and 34B being displayed. Each of the surfaces 34 to 40 may have unique messages displayed thereon, or may have message panels attached thereto. In another preferred embodiment, the pairs of surfaces 34 to 40 visible at the same time (e.g. surfaces 36 and 34B of FIG. 4) may display the same message so that passersby in both directions see the same message.

The present invention also provides signs with one or more of the surfaces 34 to 40 being blank. Thus, when the blank surface is displayed on one side of the sign 10, and the other side displays a message, the sign 10 may be read from only the one side, in effect creating a "one-way" sign. Such one-way signs are particularly useful in applications where traffic moving in one direction needs to be appraised of a message, whereas traffic in the other direction does not. An exemplary sign 10 that displays the message "Do Not Enter" on one side and nothing on the other side may be set at an exit to discourage traffic from entering the exit while allowing exiting traffic to proceed. In an alternative, two of the movable panels 20 may include blank surfaces that are positioned relative to one another such that the two blank surfaces may be visible at the same time on opposite sides of the sign 10. When the sign 10 is not in use, the blank surfaces may thus be "displayed" thereby saving the message bearing surfaces from wear and tear (particularly sunlight induced fading).

To aid the user in selecting the panels 12 and 20 to display, index tabs 42 may be provided on the distal ends 47 of the movable panels 20 with labels to identify the message displayed thereon (see FIG. 1). The support panels 12 may also have identifying labels affixed thereto (not shown) positioned to be visible even with the movable panels 20 lying thereover. Preferably, the movable panels 20 include a length 44 that is shorter than the length 33 of the support panels 12 to avoid interference from the floor as the panels 20 move along the runners 22 about the handle 14.

Figure 5:
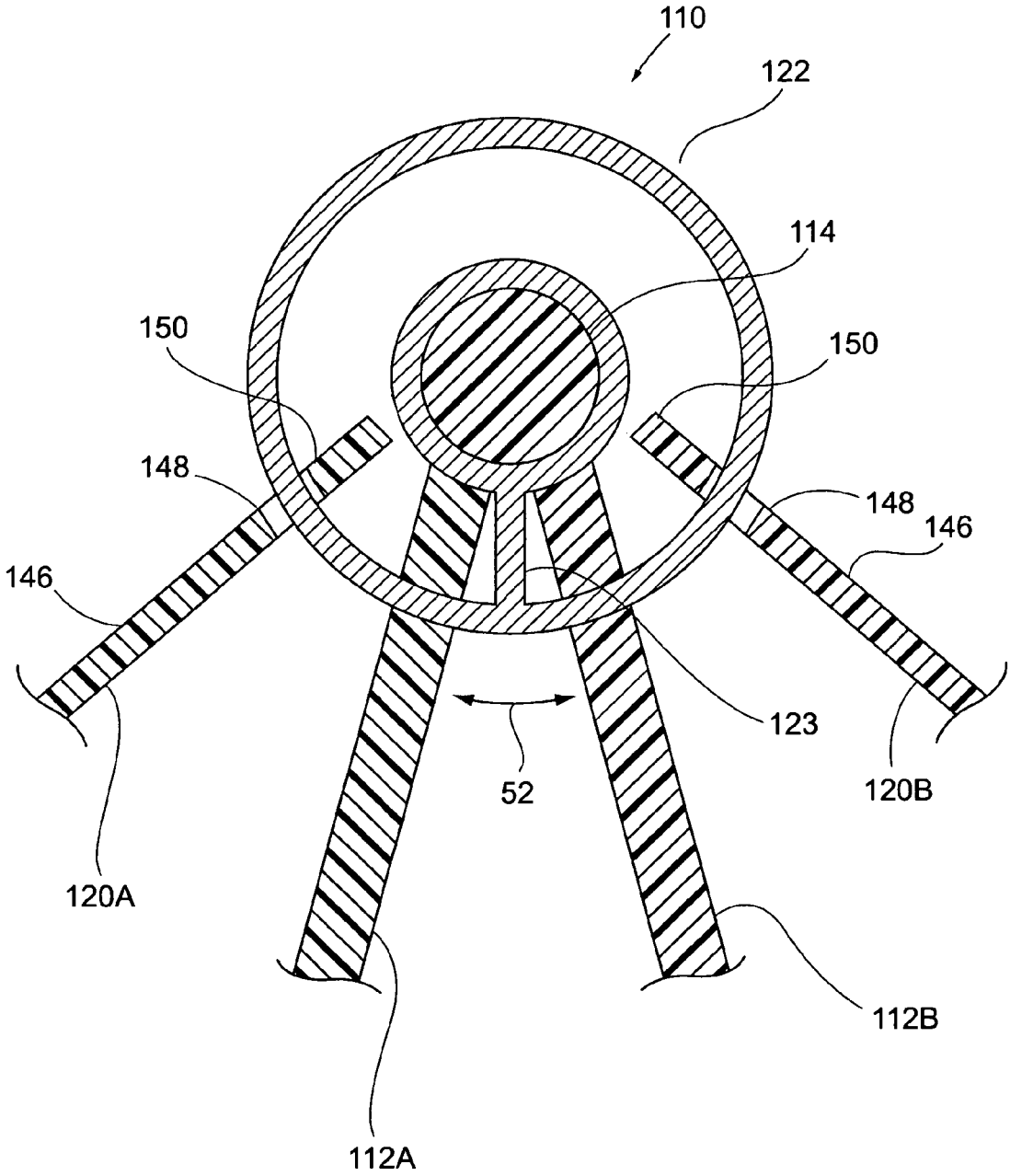
FIG. 5 is a detail view taken along line 5-5 in FIG. 1 of a preferred embodiment of a runner of the sign of FIG. 1.

With reference to FIG. 5, each of the movable panels 20 includes toward its proximal end 46 bushings, or eyelets 48, that lay flush in the panel 20. In a preferred embodiment, the eyelets 48 are unlined holes defined by the body of the movable panels 20, although the holes 48 could include bushings or other liners to reduce wear between the movable panels 20 and the runners 22. If so, it is preferred that the bushings are either flush with, or recessed into, the body of the movable panel 20. The eyelet 48 slides along the runner 22 to enable the positioning of the movable panels 20 as discussed herein. By employing eyelets 48 that lie entirely within, or parallel to, the panel 20, the present invention enjoys a number of advantages over prior attempts at providing multi-use signs. First, the eyelet 48 allows for a panel 20 having a thinner profile and lighter construction. The present invention also requires no cooperation between panels 12 and 20 to display a message. Additionally, a given panel 12 or 20 conveys an entire message whether other adjacent panels 12 or 20 have been correctly positioned adjacent it. Thus, the assembly and use of the sign 10 is simple, quick, and inexpensive.

A comparison of FIGS. 3 and 4 shows additional features of the runner 22. In particular, the runner 22 may float with respect to the handle 14. FIG. 3 shows the runner 22 concentrically positioned relative to the handle 14, whereas FIG. 4 shows the center of runner 22 offset from the center of the handle 14. The runner 22 is retained by the sign 10, for example by the runner 22 passing through the handle aperture 24 (see FIG. 2). A coupling between the runner 22 and the handle 14, therefore, is not necessary for the successful practice of the current invention, although the runner 24 could be coupled to the handle 14. For instance, the runner 22 could be molded into the handle 14. Nor does the runner 22 have to completely encircle the handle 14. Rather, the runner 22 may partially encircle the handle 14, as shown by FIG. 4 wherein the runner 22 is open between the support panels 12. With such a runner 22, the user may slightly spread the open ends of the runner 22 and slip it over the handle 14 to place the movable panels 20 on the sign 10. Preferably, a pair of appropriately sized stops (not shown) on either open end of the runner 22 prevents the movable panels 20 from sliding off the runner 22.

In another preferred embodiment, the bodies of the support and movable panels 12 and 20 extend through the area where the handle aperture 24 is illustrated. In other words, the current embodiment includes no handle aperture 24. Thus, the area of the surfaces 34, 36, 38, and 40 (and opposite surfaces 34', 36', 38', and 40' as well) is expanded to include larger messages. This embodiment is particularly well-suited for displaying messages conveyed in more than one language. Thus, for example a message could be conveyed on one a surface in both English and Spanish. Further, a separate handle may be added to the sign by adapting the handle to engage the runners 22 in a manner similar to the manner the movable panels 20 engage the runners 22 (i.e. providing eyelets in the handle body that are spaced apart the same distance as the runners 22 are spaced apart). In the alternative, the handle may include detents that snap over the runners 22 so as to leave the handle slidably engaging the runners 22.

In operation, the user grips the handle 14 and carries the sign 10 to a desired position for display. The user then sets the sign 10 on the floor and adjusts the angle 52 between the panels 12 using hinges 16. Also, the user may minimize the angle 52 for storage by closing the support panels 12. Otherwise, the panels 12 generally remain stable with their distal ends spaced apart to support the sign 10 on the floor in an upright position when the sign 10 is in use. If the sign 10 is not already displaying the desired message, the user reads the index tabs 42 to identify the message desired for display. Then the user slides the appropriate panels 20 along the runner 22 to the other side of the sign 10, thereby displaying the desired message. A latch, clamp, clasp, or snap 53 is also coupled to the support panels 12 so that when the movable panels 20 have been moved to the desired positions, the latch 53 secures the movable panels 20 in position against the support panels 12. The latch 53 also provides added convenience in that the latch 53 may be used to secure the movable panels 20 when the user wishes to move the sign 10 to a new location. Additionally, a hook 26 that is in, or adjacent to, the aperture 24 may be provided to allow cordon tape/rope to be strung through a series of signs 10. Thus, the signs 10 also provide access control.

With reference now to FIG. 5, a runner 122 is shown positioned concentrically around a handle 114. A retainer 123 is shown coupling the runner 122 to the handle 114. Because the retainer 123 is positioned within the angle 52 the movable panels 120 may rotate to the desired positions without interference from the retainer 123. FIG. 5 also shows extensions 150 of the proximal ends 146 of the movable panels 120 in accordance with another preferred embodiment. Generally, the extensions 150 extend from the eyelets 148 and toward the handle 114. Further, the extension 150 is shown extending to the near proximity of, and nearly abutting, the handle 114 (or retainer 123). A small gap is shown between the extension 150 and the handle 114 that facilitates movement of the movable panels 120. In one embodiment, all of the movable panels 120 on the sign 110 include extensions 150 of the same length so that all of the extensions 150 nearly abut the handle 114. Accordingly, the movable panels 120, acting in cooperation, center the runner 122 about the handle 114 even in the absence of a retainer 123. Thus the panels 120 will move smoothly along the runner 122 without undue play therebetween. Of course, the extensions 150 may be of any length that allows movement of the movable panels 120 on the runner 122.

Those skilled in the art will also recognize that whereas, the runner 122 and handle 114 have been shown to be circular, no corresponding limitations are thereby implied regarding the invention. Generally, the runner 122 may be flexible or rigid and may have any suitable shape allowing the desired motion of the movable panels 120. For instance, the runner 122 may be a ring, a band, a lanyard, a string, a chain, a loop, or any other suitable device allowing the desired motion of the movable panels.

Figure 6:
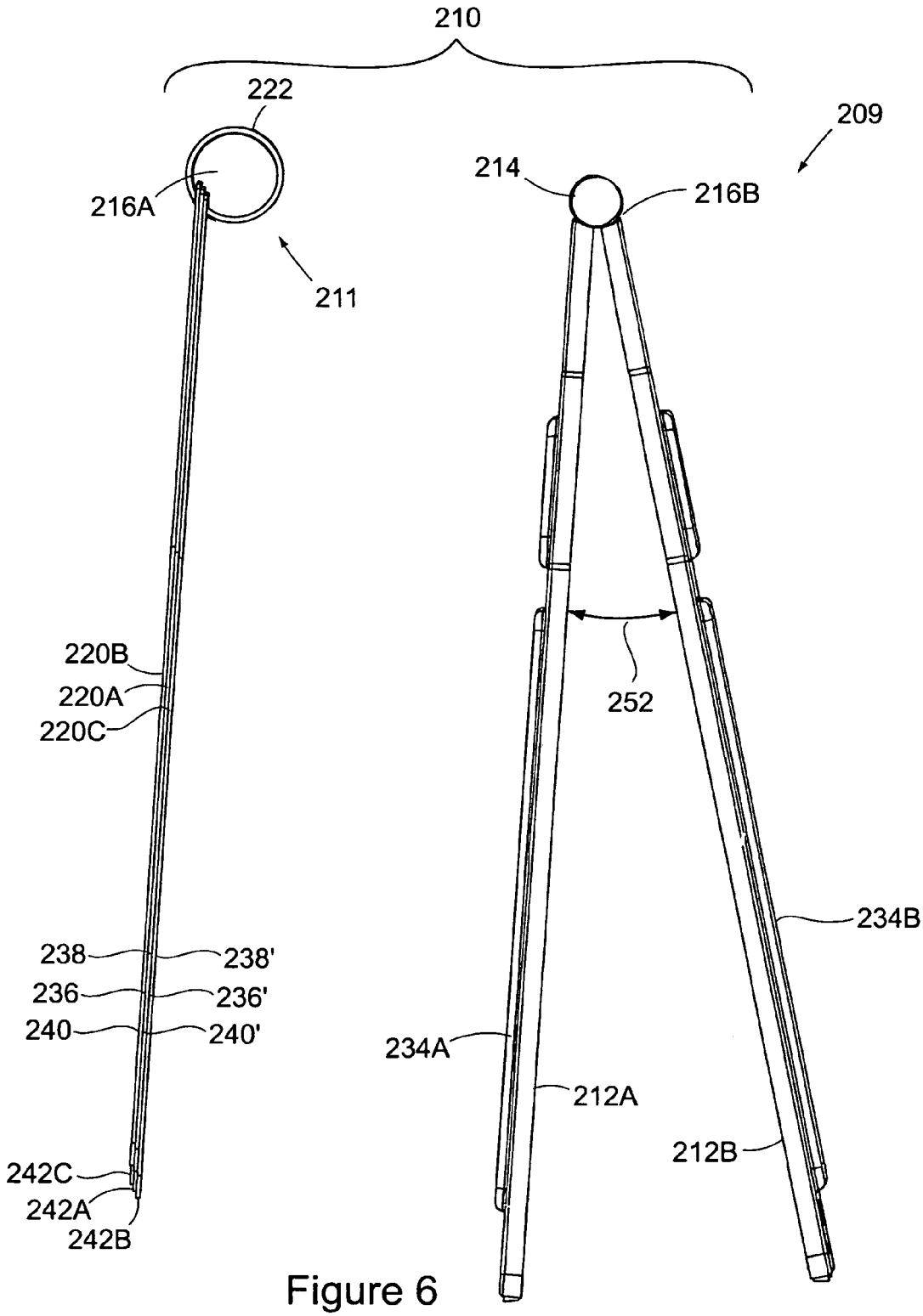
FIG. 6 illustrates another preferred embodiment of the present invention.

Now with reference to FIG. 6, yet another preferred embodiment of the present invention is illustrated. The current embodiment includes a kit, accessory, or retrofit assembly 211 for adding multi-use capability to a conventional single-use floor sign. As show, the sign 209 typically includes a pair of support panels 212, a transverse handle 214 and two surfaces 234A and 234B for displaying messages.

The accessory 211 includes a plurality of movable panels 220 and a runner 222 as shown. To convert the single-use sign 209 to a multi-use sign, the user removes the support panels 212 from the handle 214. The user slips the runner 222 over the handle 214 and reassembles the sign with the runner 222 positioned in the handle aperture 224. Once on the sign 209, the movable panels 220 may then be positioned to show any of the multiplicity of messages thereon.

Figure 7:
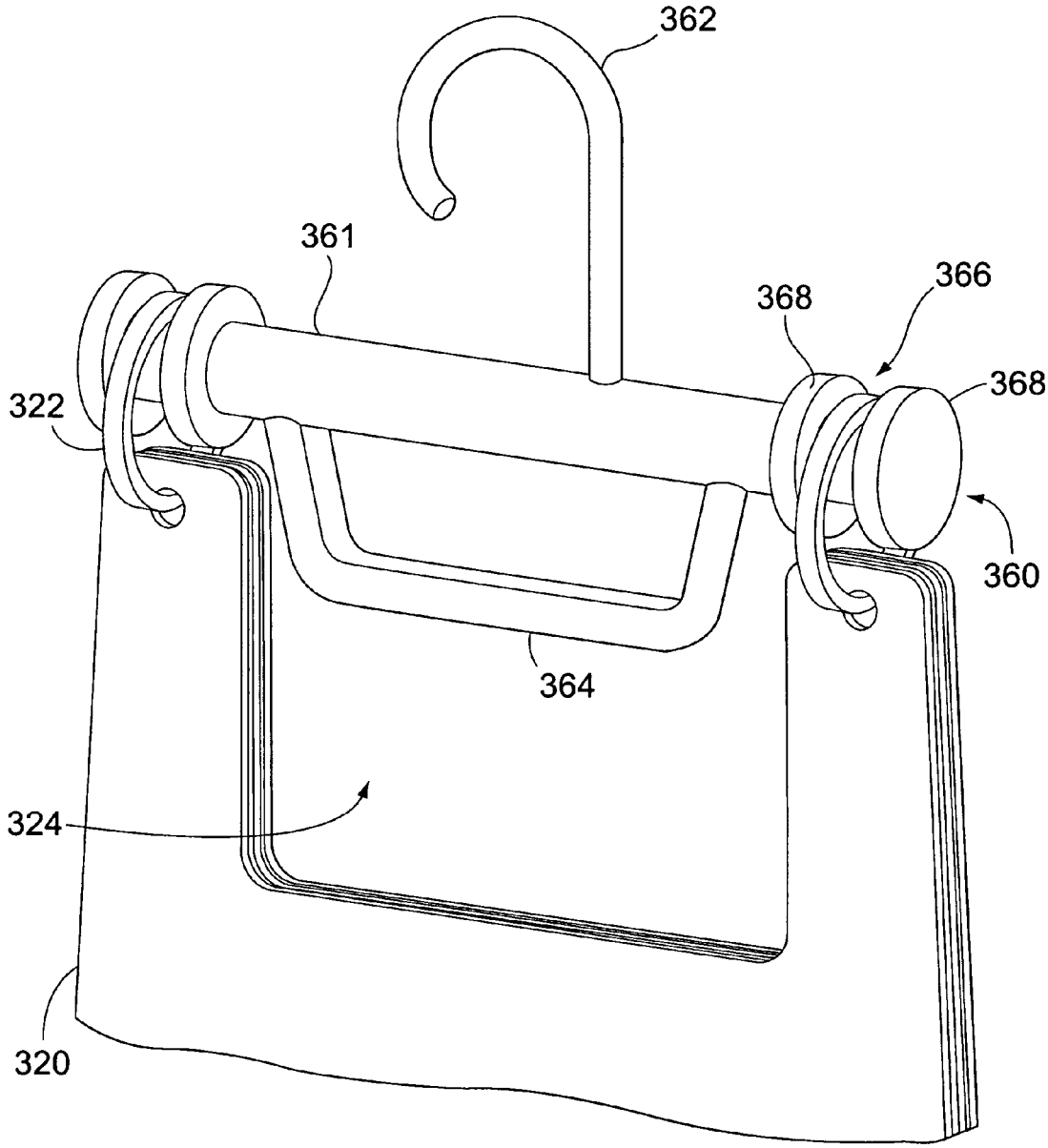
FIG. 7 illustrates yet another preferred embodiment of the present invention.

With reference now to FIG. 7, a kit, or sign, constructed in accordance with another preferred embodiment of the present invention is shown. The kit 311 generally includes a different support arrangement then in the previous embodiments. Though the support arrangement shown in FIG. 7 may be adapted for use with the other embodiments without departing from the spirit and scope of the present invention.

More particularly, the support 360 includes a hook 362, a hand grip 364, a race 366 and stops or retainers 368. Generally, the movable panels 320 engage, and rotate around, the runner 322 in such a manner as to allow the user to display the messages on the surfaces of the movable panels 320. The runners 322 at least partially encircle the transverse body 361 of the support 360 and are prevented from slipping off of the body 361 by the stops 368 that define the race 366. Thus, the support 360 may rotate within the runners 322 so that either hook 362 or grip 364 is generally disposed above the body 361. The handle aperture 324, the hook 362, and the grip 364 are sized relative to one another to facilitate the rotation of the support 360. With the hook 362 disposed above the body 361 the kit 311 may be hung from a rail, hook, or other suitable structure for display whereas the grip 364 being disposed above the body 361 facilitates the user's ability to carry the kit 311 and the sign 309 (when the kit 311 is on the sign 309). In the alternative, the stops 368 may be sized smaller than the inside diameter of the runner 322 to allow the user to slip the support 360 through the runners, With the support 360 so removed from the kit 311, the kit 311 may then be added to signs in which the hook 362 and grip 364 are not necessary (e.g. the self-standing floor sign 10 of FIG. 1).

Also, while a hook 362 associated with the runners 322 via the support 360 has been illustrated for supporting the kit 311 as a self contained sign, the support 360 may instead (or in addition) include a clamp, clasp, snap, eyelet or other device suited for the intended purpose of hanging the sign 311 from an overhead support. Additionally, the hook 362 may be associated with a movable panel 320 by, for example, being coupled to the movable panel 320 instead of being associated with the runner 322.

In view of the foregoing, it will be seen that the several advantages of the invention are achieved and attained. Numerous embodiments of multi-use self-standing floor signs have been described. Additionally, the present invention eliminates the need for separate storage of single use signs. Moreover, because various messages are provided on the signs in accordance with the present invention, users may quickly change the message displayed by a sign by re-positioning movable panels. Moreover, one sign may be employed in a number of different applications thereby reducing the required inventory of signs otherwise required.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A sign comprising:

a pair of support panels each having opposite upper and lower ends and each having a first surface and a generally opposite second surface, the upper ends of the pair of panels being connected together by a pivoting connection that enables the pair of support panels to be moved to operative positions where the pair of support panels define an angle between the pair of support panels and the lower ends of the pair of support panels are engageable with a surface to orient the pair of support panels upright with the angle defined between the pair of support panels;

a runner adjacent to the upper ends of the support panels and adjacent to the pivoting connection, the runner extending generally from the first surface of a first support panel of the pair to the second surface of a second support panel of the pair; and at least one movable panel having an upper end, a lower end, and a third surface between the upper and lower ends, the upper end of the movable panel engaging the runner in a manner so that the movable panel is movable along the runner between a first position wherein the movable panel is generally parallel to the first surface of the first support panel when the pair of support panels are in the operative positions and a second position wherein the movable panel is generally parallel to the second surface of the second support panel when the pair of support panels are in the operative positions.

2. The sign according to claim 1, further comprising:

a first and a second movable panel of the at least one movable panel, the first and second movable panels each having opposite surfaces for displaying a message.

3. The sign according to claim 1, wherein the runner and the upper ends of the support panels are coupled.

4. The sign according to claim 1, further comprising:

the runner being circular.

5. The sign according to claim 1, wherein:

the runner is flexible.

6. The sign according to claim 1, further comprising:

an eyelet at the upper end of the at least one movable panel, the movable panel engaging the runner by the runner extending through the eyelet.

7. A sign comprising:

a pair of support panels each having opposite upper and lower ends and each having a first surface and a generally opposite second surface, the upper ends of the pair of panels being connected together by a pivoting connection;

a runner adjacent to the upper ends of the support panels and adjacent to the pivotinci connection, the runner extending generally from the first surface of a first support panel of the pair to the second surface of a second support panel of the pair;

at least one movable panel having an upper end, a lower end, and a third surface between the upper and lower ends, the upper end of the movable panel engaging the runner in a manner so that the movable panel is movable along the runner between a first position wherein the movable panel is generally parallel to the first surface of the first support panel and a second position wherein the movable panel is generally parallel to the second surface of the second support panel; and, a transverse handle connected by the pivoting connection to the first and second support panels, the transverse handle and the support panels defining a handle aperture adjacent the handle, whereby a user grips the handle.

8. The sign according to claim 7, wherein:

the runner extends through the handle aperture.

9. The sign according to claim 7, further comprising:

the handle aperture extending through the at least one movable panel.

10. A self-standing sign comprising:

a first support panel having a proximal end, a distal end, and a first surface between its proximal and distal ends;

a second support panel having a proximal end, a distal end, and a second surface between its proximal and distal ends, the first and second panels being connected to one another at their proximal ends by a connection that allows the first and second support panels to move relative to each other and in a manner so that the first and second surfaces face outwardly and that enables the first and second support panels to move to relative positions where the first and second support panels define an angle between the first and second support panels the distal ends of the first and second panels being adapted for supporting the sign from a support surface with the distal ends of the first and second support panels engaging the support surface and orienting the first and second support panels upright with the angle defined between the first and second support panels;

a runner adjacent the proximal ends of the first and second panels and extending generally from the proximal end of the first panel to the proximal end of the second panel, the runner being separate from the connection; and at least one movable panel having a proximal end, a distal end, and a third surface between its proximal and distal ends, the proximal end of the movable panel engaging the runner in a manner so that the movable panel is movable along the runner between a first position wherein the movable panel is generally parallel to the first panel when the first and second support panels are in the relative positions with the angle defined between the first and second support panels and a second position wherein the movable panel is generally parallel to the second panel when the first and second support panels are in the relative positions with the angle defined between the first and second support panels.

11. The sign according to claim 10, further comprising:

a first and a second movable panel of the at least one movable panel, the surfaces of the first and second movable panels for displaying the same message.

12. The sign according to claim 10, further comprising:

a fourth surface on the side of the movable panel opposite the third surface.

13. The sign according to claim 10, wherein:

the runner and the proximal ends of the first and second support panels are coupled.

14. The sign according to claim 10, further comprising:

an extension of the at least one movable panel extending from the proximal end of the movable panel, the runner being circular.

15. The sign according to claim 10, wherein:

the runner is flexible.

16. The sign according to claim 10, further comprising:

an eyelet at the proximal end of the at least one movable panel, the movable panel engaging the runner via the eyelet.

17. A self-standing sign comprising:

a first support panel having a proximal end, a distal end, and a first surface between its proximal and distal ends;

a second support panel having a proximal end, a distal end, and a second surface between its proximal and distal ends, the first and second panels being connected to one another at their proximal ends by a connection that allows the first and second support panels to move relative to each other and in a manner so that the first and second surfaces face outwardly, the distal ends of the first and second panels being adapted for supporting the sign from a support surface;

a runner adjacent the proximal ends of the first and second panels and extending generally from the proximal end of the first panel to the proximal end of the second panel, the runner being separate from the connection;

at least one movable panel having a proximal end, a distal end, and a third surface between its proximal and distal ends, the proximal end of the movable panel engaging the runner in a manner so that the movable panel is movable along the runner between a first position wherein the movable panel is generally parallel to the first panel and a second position wherein the movable panel is generally parallel to the second panel; and, a transverse handle, both support panels being hingedly connected by the connection to the transverse handle, the transverse handle and the support panels defining a handle aperture adjacent the handle, whereby the user grips the handle.

18. The sign according to claim 17, further comprising:

the handle aperture extending through the at least one movable panel.

19. The sign according to claim 17, wherein:

the runner extends through the handle aperture.

20. A kit for a sign comprising:

a pair of support panels each having opposite proximal and distal ends and each having a first surface, and a generally opposite second surface, the proximal ends of the support panels being connected together by a pivoting connection that enables the pair of support panels to be moved to operative positions where the pair of support panels define an angle between the pair of support panels and the distal ends of the pair of support panels are engageable with a surface to orient the pair of support panels upright with the angle defined between the pair of support panels;

a runner positioned adjacent to the proximal ends of the support panels and to the pivoting connection, the runner extending from the first surface to the second surface; and at least one movable panel having a proximal end, a distal end, and a third surface between its proximal and distal ends, the proximal end of the movable panel engaging the runner in a manner so that the movable panel is movable along the runner between a first position wherein the movable panel is to be generally parallel to the first surface when the pair of support panels are in the operative positions and a second position wherein the movable panel is to be generally parallel to the second surface when the pair of support panels are in the operative positions.

21. The kit according to claim 20, further comprising:

a first and a second movable panel of the at least one movable panel, with surfaces of the first and second movable panels for displaying a same message.

22. The kit according to claim 20, wherein:

the runner is adapted to be coupled to the proximal ends of the support panels.

23. The kit according to claim 20, further comprising:

an extension of the at least one movable panel extending from the proximal end of the movable panel, and the runner being circular.

24. The kit according to claim 20, wherein:

the runner is flexible.

25. The kit according to claim 20, further comprising:

an eyelet at the proximal end of the at least one movable panel, the movable panel engaging the runner via the eyelet.

26. The kit according to claim 20, further comprising:

an aperture in the proximal end of the at least one movable panel, the runner extending through the aperture.

27. A kit for a sign comprising:

a pair of support panels each having opposite proximal and distal ends and each having a first surface, and a generally opposite second surface, the proximal ends of the support panels being connected together by a pivoting connection;

a runner positioned adjacent to the proximal ends of the support panels and to the pivoting connection, the runner extending from the first surface to the second surface;

at least one movable panel having a proximal end, a distal end, and a third surface between its proximal and distal ends, the proximal end of the movable panel engaging the runner in a manner so that the movable panel is movable along the runner between a first position wherein the movable panel is to be generally parallel to the first surface and a second position wherein the movable panel is to be generally parallel to the second surface; and, the pair of support panels have handle apertures and the runner extend through the handle apertures.

28. A kit for a sign comprising:

a pair of support panels each having opposite proximal and distal ends and each having a first surface, and a generally opposite second surface, the proximal ends of the support panels being connected together by a pivoting connection;

a runner positioned adjacent to the proximal ends of the support panels and to the pivoting connection, the runner extending from the first surface to the second surface;

at least one movable panel having a proximal end, a distal end, and a third surface between its proximal and distal ends, the proximal end of the movable panel engaging the runner in a manner so that the movable panel is movable along the runner between a first position wherein the movable panel is to be generally parallel to the first surface and a second position wherein the movable panel is to be generally parallel to the second surface; and, a hook provided on one of the support panels and the at least one movable panel.

29. A self-standing floor sign, comprising:

a first support panel;

a second support panel, each of the support panels including a proximal end, a distal end, and a surface for displaying a message;

a transverse handle hingedly coupled to the proximal ends in a manner so that the support panels define a first and a second side of the sign and so that the handle and the support panels define a handle aperture adjacent to the handle to allow a user to grasp the handle, the distal ends to rest on a floor;

a ring encircling the handle, the handle and the first support panel retaining the ring in the handle aperture; and a first and a second movable panel, each of the movable panels including at least one surface for displaying a message and each having a proximal end including an eyelet slidably engaging the ring, the handle aperture extending through the movable panels whereby movable panels slide along the ring in a manner so that the user may select the messages to be displayed by the sign.

30. A method of changing a message displayed by a sign, comprising:

placing the sign in a location for viewing, the sign including a pair of support panels connected by a pivoting connection, each panel having a first surface and a generally opposite second surface and at least one movable panel having a proximal end, a distal end, and a third surface between its proximal and distal ends;

connecting the movable panel to the support panels by a circular runner;

selecting at least one of the surfaces for display;

moving the at least one movable panels along the runner to display the selected surface, the moving being from a first position wherein the at least one movable panel is generally parallel to the first surface to a second position wherein the at least one movable panel is generally parallel to the second surface; and, retaining the runner in a handle aperture of the sign.

31. A self-standing floor sign comprising:

first and second support panels, each having a proximal end and a distal end, said panels being pivotally connected at their proximal ends by a pivot connection to allow pivotal movement of said panels relative to each other between a closed position wherein the panels are in generally parallel relation and an open position wherein the first and second support panels define an angle between the first and second support panels and the distal ends of said panels are spaced apart to allow support of the floor sign in a generally upright position with the spaced apart distal ends resting on a floor;

a runner connected to the support panels; and a plurality of movable panels, each having a proximal end and a distal end and a portion therebetween having first and second surfaces, each movable panel being mounted on the runner and being rotatable between a first position wherein said movable panel is supported by one of said support panels with one of its surfaces being visible when the first and second support panels are in the open position, and a second position wherein said movable panel is supported by the other of said support panels and its other surface is visible when the first and second support panels are in the open position.

32. A self-standing floor sign of claim 31 wherein:

at least one of said first and second support panels has an outwardly facing display portion.

33. A self-standing floor sign of claim 31 wherein:

both of said first and second support panels have outwardly facing display portions.

34. A self-standing floor sign of claim 33 wherein:

each of said movable panels has a display on both of its surfaces.

35. A self-standing floor sign of claim 31 wherein:

each of said movable panels has a display on at least one of its surfaces.

36. A self-standing floor sign of claim 35 wherein:

a display on a surface of one of the movable panels is the same as a display on a surface of another of the movable panels, said displays both being visible with one of the movable panels rotated to said first position and an other of said movable panels rotated to said second position.

37. A self-standing floor sign of claim 36 wherein:

at least one of said first and second support panels has an outwardly facing display portion.

38. A self-standing floor sign of claim 36 wherein:

both of said first and second support panels have outwardly facing display portions.

39. A self-standing floor sign of claim 35 wherein:

said first support panel has an outwardly facing display portion and a display on a surface of one of the movable panels is the same as a display on a surface of the first support panel, said displays both being visible with said one of the movable panels rotated to said first position wherein said one of the movable panels is supported by the second support panel.

40. A self-standing floor sign of claim 31 wherein:

each of said movable panels has a display on both of its surfaces.

41. The self-standing floor sign of claim 31, wherein:

at least one of said first and second support panels has an outwardly facing display portion and wherein at least one of the display portions of the support panels and a display on a surface of one of the movable panels is blank.

42. The self-standing floor sign of claim 31, wherein:

at least one of said first and second support panels has an outwardly facing display portion that is blank.

43. The self-standing floor sign of claim 31, wherein:

at least one of said first and second support panels has an outwardly facing display portion that displays a message in a plurality of languages.

44. A self-standing floor sign comprising:

first and second support panels, each having a proximal end and a distal end, said panels being pivotally connected at their proximal ends by a pivot connection to allow pivotal movement of said panels relative to each other between a closed position wherein the panels are in generally parallel relation and an open position wherein the distal ends of said panels are spaced apart to allow support of the floor sign in a generally upright position with the spaced apart distal ends resting on a floor;

a runner connected to the support panels;

a plurality of movable panels, each having a proximal end and a distal end and a portion therebetween having first and second surfaces, each movable panel being mounted on the runner and being rotatable between a first position wherein said movable panel is supported by one of said support panels with one of its surfaces being visible, and a second position wherein said movable panel is supported by the other of said support panels and its other surface is visible; and, a latch coupled to one of the support panels and removably coupled to at least one of the movable panels whereby the latch secures at least one of the movable panels to the support panel.

* * * * *